United States Patent [19]

Phillips et al.

[11] 4,416,337

[45] Nov. 22, 1983

[54] DRILL HEAD ASSEMBLY

[76] Inventors: Albert Phillips, 465 Kiwanis Ave.; Donald L. DeVall, 1082 Charles Ave.; Hu D. DeVall, Rte 1, Box 362A, all of Morgantown, W. Va. 26505

[21] Appl. No.: 267,090

[22] Filed: May 26, 1981

Related U.S. Application Data

[63] Continuation of Ser. No. 46,812, Jun. 8, 1979, abandoned.

[51] Int. Cl.[3] ..... E21C 7/02

[52] U.S. Cl. ..... 173/57; 773/DIG. 3

[58] Field of Search ..... 173/57, 74, 79, DIG. 3; 279/1 S

[56] References Cited

U.S. PATENT DOCUMENTS

| | | | |
|---|---|---|---|
| 2,365,810 | 12/1944 | Faso | 279/1 S |
| 3,190,369 | 6/1965 | Pyles | 173/23 |
| 3,461,974 | 8/1969 | Bartos | 173/79 X |
| 3,544,121 | 12/1970 | Mizoguchi | 279/1 S |
| 3,547,206 | 12/1970 | Phillips | 173/57 X |
| 3,654,961 | 4/1972 | Phillips | 137/624.13 |
| 3,685,593 | 8/1972 | Amtsberg et al. | 173/DIG. 3 |
| 3,766,991 | 10/1973 | Brown | 173/57 X |
| 3,800,887 | 4/1974 | West | 173/57 |
| 3,901,330 | 8/1975 | Slator et al. | 173/57 |
| 4,024,923 | 5/1977 | Broadbent | 173/57 |
| 4,190,116 | 2/1980 | O'Neal et al. | 173/DIG. 3 X |
| 4,294,317 | 10/1981 | Amoroso | 173/57 |

OTHER PUBLICATIONS

Drawing No. 4–010468, 1/73, Entitled "Dooley Impact Drill Box Gear Case", Lee–Norse Company, Taylorville, Ill.

Drawing, No. 51822, 11/72, Entitled "Universal Drillhead", J. H. Fletcher & Co., Huntington, W. Va.

Drawing No. 51874, 12/77 Entitled "Drillhead Assembly," J. H. Fletcher & Co., Huntington, W. Va.

Drawing No. 308D9, 7/77, Entitled "Deep Socket Drill Pot", FMC Mining Equipment, Fairmount, West Virginia.

Drawing No. 5308D9, 6/77, Entitled "Deep Socket Drill Pot Layout", FMC Mining Equipment, Fairmount, West Virginia.

*Primary Examiner*—Wm. Carter Reynolds

*Attorney, Agent, or Firm*—Stanley J. Price, Jr.; John M. Adams

[57] ABSTRACT

A drill housing includes an internal cavity for receiving a unitary tubular support member rotatably supported by bearing assemblies in the drill housing. The tubular support member is connected through meshing gears to a drive shaft of a rotary motor mounted externally on the drill housing. An upper end portion of the tubular support member is rotatably supported by a first bearing assembly and is nonrotatably connected to a drill retaining member that extends into a central bore of the tubular support member. The drill retaining member has a socket for receiving the shank of a drill steel. A lower end portion of the tubular support member is rotatably supported by a second bearing assembly. An enlarged intermediate body portion of the support member separates the upper and lower end portions and supports the first and second bearing asemblies. The lateral thrust of the drill steel is applied to the enlarged intermediate body portion and thereby removed from the bearing assemblies to reduce wear of the bearing assemblies. A carrier member is positioned in an annular space between the tubular support member lower end portion and the drill housing. The carrier member supports a plurality of overlying O-ring seal members in surrounding relation with the tubular support member to prevent loss of lubricant from the second bearing assembly and the entrance of rock cuttings and dust into the drill housing.

5 Claims, 4 Drawing Figures

DRILL HEAD ASSEMBLY

CROSS REFERENCE TO RELATED APPLICATIONS

This application is a continuation of copending application Ser. No., 046,812 filed on June 8, 1979, entitled "Drill Head Assembly" by Albert Phillips and now abandoned.

BACKGROUND OF THE INVENTION

1. Field of the Invention

This invention relates to an improved rotary drill and particularly to a drill head assembly for a rotary drill in which a seal arrangement is provided for increasing the life of the bearings and the bearings are supported in a manner to reduce bearing wear and increase the operating efficiency of the rotary drill.

2. Description of the Prior Art

In rock drilling operations, it is the conventionally known practice to drill holes in a rock formation by a rotary drill assembly or by a rotary percussion drill assembly. U.S. Pat. Nos. 3,547,206 and 3,654,961 are examples of such drill assemblies which includes a drill pot that carries a hydraulic motor having a motor shaft nonrotatably connected to a bevel gear which meshes with another bevel gear rotatably journaled on a support member or hub within the drill pot housing. The hub is fixed to a rotatable head or pot cover and has a seat into which the shank of a drill steel is received. A drill bit is positioned on the upper end of the drill steel. With this arrangement rotation of the motor shaft is transmitted to the drill steel to rotate the drill bit.

Generally, the drill assembly is incorporated with a self-propelled machine that maneuvers the drill pot into position and moves the drill pot in the axial direction of advancement of the drill bit into the rock formation. For rock drilling operations in an underground mine the drill assembly is supported by a boom that is pivotally mounted on the front of a mobile frame. Upward pivotal movement of the boom moves a drill steel seated in the pot cover into drilling position. As the drill steel rotates, the boom exerts upward pressure upon the drilling assembly to increase the driving thrust upon the drill steel. This advances the drill steel vertically into the rock formation as rock material is dislodged to form an elongated bore in the rock formation. The upward force exerted upon the drill assembly by the boom overcomes the resistance encountered by the rock structure to rotation of the drill bit. An example of such a drilling machine is disclosed in U.S. Pat. No. 3,190,369.

As the drill bit advances into the rock formation by the upward thrust applied by the drill boom, the resistive forces encountered exert tremendous lateral forces on the drill steel. The lateral thrust forces are transmitted through the drill steel to the drill retaining member and to the bearings which rotatably support the drill retaining member. The effect of the lateral thrust forces is to displace the bearing carriers so that the bearings are no longer maintained in axial alignment in the drill pot. This results in wear of the bearings requiring that the drill assembly be removed from operation for repair of the worn bearings. In addition misalignment of the bearings destroys the seals around the bearings permitting lubricant to escape from the bearings and the entrance of dust and other foreign matter into the drill assembly. Consequently, drilling efficiency is substantially reduced and repair costs substantially increased.

Therefore, there is need in a rock drilling assembly for a drill head capable of withstanding the forces applied thereto during the drilling operations so as to extend the life of the bearings and maintain the drill head sealed against the entrance of foreign material.

SUMMARY OF THE INVENTION

In accordance with the present invention, there is provided a drill head that includes a drill housing having an internal cavity with an opening extending therethrough. A rotatable drill retaining member is positioned in the drill housing internal cavity and extends through the opening. The drill retaining member has a central bore therethrough. A tubular member is coaxially aligned with the drill retaining member. The tubular member has an internal bore for receiving the drill retaining member. Means is provided for nonrotatably connecting the drill retaining member to the tubular member in the internal bore thereof. A drive mechanism is positioned in the drill housing and is operable to rotate the tubular member. The tubular member has an upper end portion and a lower end portion with an intermediate body portion positioned between the upper and lower end portions. The drill retaining member is supported in the drill housing by the tubular member intermediate body portion to resist lateral thrust and thereby prevent lateral shifting movement of the drill retaining member in the drill housing. The tubular member lower end portion is positioned in the drill housing and forms an annular space between the tubular member lower end portion and the drill housing. A seal assembly is positioned in the annular space between the tubular member lower end portion and the drill housing for sealing the tubular member lower end portion in the drill housing.

The drill retaining member is adapted to receive the shank of a drill steel. The drill steel is nonrotatably secured within the central bore of the drill retaining member. Rotation transmitted to the tubular member from the drive means rotates the drill retaining member to, in turn, rotate the drill steel. The tubular member upper end portion is rotatably supported in the drill housing by a first bearing assembly, and the tubular member lower end portion is rotatably supported in the drill housing by a second bearing assembly. The first and second bearing assemblies are securely positioned in spaced relation in the drill housing by the tubular member intermediate portion. With this arrangement, the tubular member is maintained coaxially aligned with the drill retaining member so as to reduce wear upon the bearing assemblies due to misalignment of the drill retaining member by lateral thrust exerted by the drill steel upon the drill retaining member.

The tubular member intermediate body portion has an enlarged peripheral flange portion that supports a ring gear in meshing relation with a bevel pinion of the drive means. The bearing assemblies are positioned oppositely of the enlarged peripheral flange portion. The drill retaining member is supported within the tubular member opposite the enlarged flange portion. The lateral thrust applied to the drill retaining member by the drill steel is taken up by the enlarged peripheral flange portion. Thus, the lateral thrust forces are removed from the bearing assemblies and are absorbed by the enlarged peripheral flange portion of the tubular member. This arrangement substantially reduces the wear exerted upon the bearing assemblies and consequently extends the useful life of the drill head.

The lower end portion of the tubular member extends through a cylindrical carrier member. The carrier member is secured to the drill housing and includes a body portion positioned in the annular space between the tubular member lower end portion and the drill housing. The seal assembly is concentrically positioned in the carrier member central bore and sealingly engages the tubular member lower end portion. Preferably, the seal assembly includes a plurality of O-ring seal members positioned in overlying relation to one another. The O-ring seal members provide a fluid-tight seal between the body portion of the carrier member and the tubular member lower end portion.

A rigid annular member, such as a washer, is also supported by the carrier member and overlies the seal assembly. With this arrangement, the rigid annular member serves to guide the tubular member lower end portion into the carrier member bore so that the seal assembly is maintained in sealing engagement with the tubular member lower end portion to prevent the entrance of dust into the drill head. This arrangement also stabilizes the tubular member lower end portion against lateral deflection in the drill head thereby substantially reducing the deflection forces applied to the seal assembly. In this manner the life of the seal assembly is extended and the downtime for maintenance of the drill head is reduced.

Accordingly, the principal object of the present invention is to provide for a rotary drill, a drill head that includes a seal arrangement that effectively maintains lubricant in contact with the rotating parts of the drill and prevents the escape of lubricant from the drill head and the entrance of foreign material into the drill head.

Another object of the present invention is to provide a drill head assembly that includes a drill retaining member and a driven tubular member nonrotatably connected to the drill retaining member, both supported in coaxial alignment so as to resist the lateral forces applied by a drill steel to the drill retaining member and thereby reduce wear of the bearings and maintain a tightly sealed drill head.

A further object of the present invention is to provide a drill head assembly that is tightly sealed to minimize wear of the bearings and extend the life of the seals to reduce the costs and delays of maintaining the drill head in operation.

These and other objects of the present invention will be more completely disclosed and described in the following specification, the accompanying drawings and the appended claims.

DESCRIPTION OF THE PREFERRED EMBODIMENT

Figure 1:
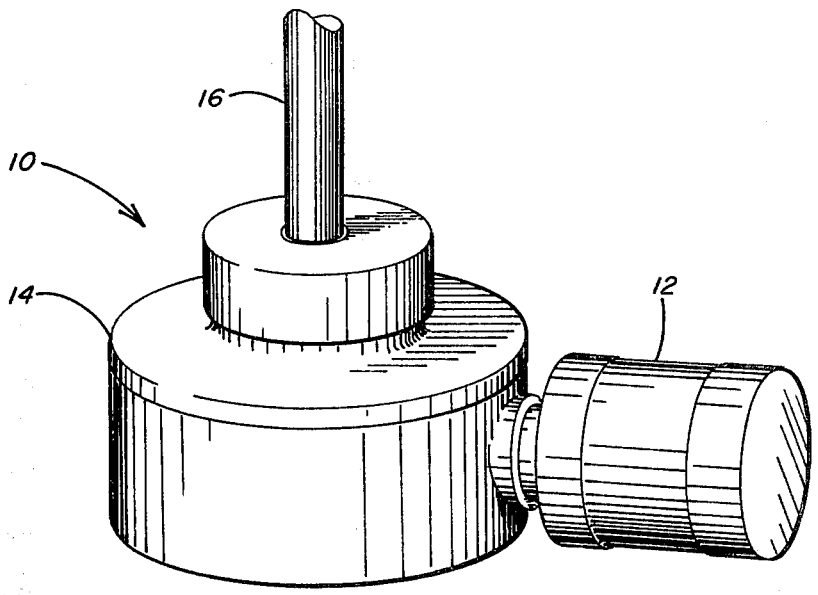
FIG. 1 is an orthographic view of an external housing of a drill head assembly of the present invention, illustrating a motor mounted on the drill head for transmitting rotary motion to a drill steel extending from the upper end of the drill head.
Figure 2:
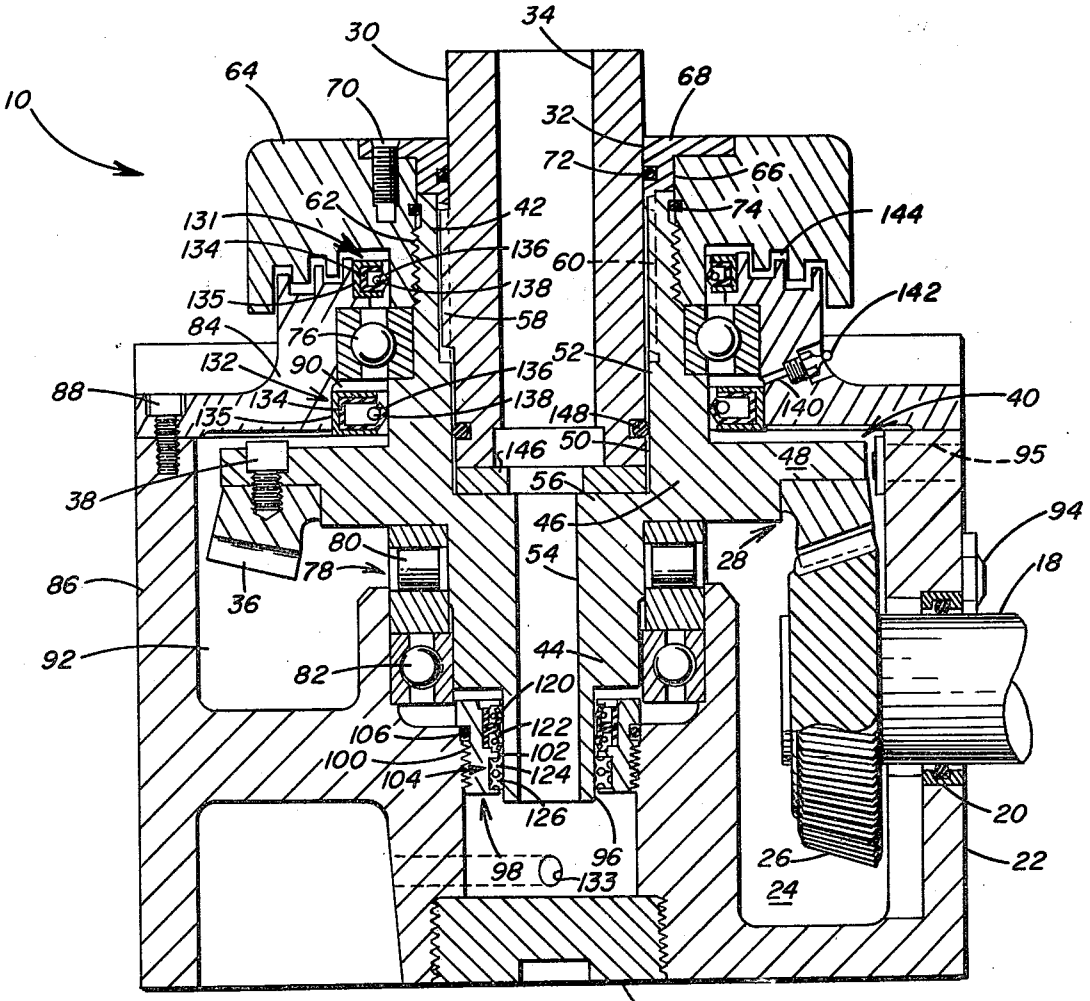
FIG. 2 is a sectional view in side elevation of the drill head shown in FIG. 1 with the drill steel removed, illustrating the seal arrangement for maintaining the drill head tightly sealed against the escape of lubricant and the entrance of dust and foreign matter.

Referring to the drawings and particularly to FIGS. 1 and 2, there is illustrated an improved rotary drill assembly generally designated by the numeral 10. The rotary drill assembly is particularly adaptable for use in underground mine drilling operations and includes a rotary motor 12. The motor 12 is preferably hydraulically operated and is drivingly connected to a drill head 14 that rotatably supports shank 16 of a drill steel. The drill steel includes a drill bit (not shown) at its upper end portion for dislodging rock material. The drill steel and drill bit are centrally bored to facilitate removal from the drilled hole rock dust ground by the bit.

The rotary drill assembly 10 of the present invention is particularly adapted for use in drilling bolt holes in a mine roof of an underground mine in which holes roof bolt devices are installed to support the roof above the mine passageway. In one mode of operation, the drill head 14 is pivotally connected to a pair of parallel, spaced boom members that project outwardly from a mobile vehicle. The vehicle moves the rotary drill to selected locations in the mine for drilling bolt holes in the mine roof and inserting roof bolts in the drilled holes. Once the vehicle is moved to a selected location in the mine passageway, the boom members are raised vertically as the rotating drill bit is advanced into the mine roof. Solid material is dislodged forming an elongated hole for receiving a roof bolt. It will also be apparent from the present invention that the rotary drill assembly 10 is adapted with other types of mine roof drilling machines, such as a mast-type drilling machine.

The rotary motor 12 is mounted on the drill head 14 and includes, as illustrated in FIG. 2, a drive shaft 18 that extends through an opening 20 of drill housing 22 into an internal cavity 24 of the drill head 14. A bevel pinion 26 is positioned in the internal cavity 24 and is nonrotatably connected to the end of the drive shaft 18. The bevel pinion 26 is drivingly connected through a drive mechanism generally designated by the numeral 28 to a drill retaining member 30, such as a rotatable chuck. The drill retaining member 30 is supported in the drill housing 22 to extend through an opening 32 in the upper end portion of the drill housing.

The rotatable drill retaining member 30 includes a socket 34 into which the shank of the drill steel is received. The rotary motor 12 is remotely controlled to rotate the drive shaft 18 at a preselected speed. Rotation is transmitted from shaft 18 through the bevel pinion 26 and the drive mechanism 28 to the drill retaining member 30. The drill steel (not shown in FIG. 2) is nonrotatably secured within the socket 34 so that rotation of the drill retaining member is transmitted to the drill steel.

The drive mechanism 28 includes a ring gear 36 that is nonrotatably connected by bolts 38 to a support member generally designated by the numeral 40. The member 40 supports the drill retaining member 30 for rotation in the drill housing 22. The support member 40 includes a unitary tubular body portion having an elongated upper end portion 42, an elongated lower end portion 44, and an intermediate body portion 46 positioned between the upper and lower end portions 42 and 44. The intermediate body portion 46 includes an enlarged peripheral flange portion 48. The ring gear 36 is nonrotatably secured to the peripheral flange portion 48.

The tubular support member 40 is provided with an axial internal bore 50 that includes an enlarged diameter upper end portion 52 and a reduced diameter lower end portion 54 with a shoulder 56 extending into the bore 50 and separating the bore portions 52 and 54. Preferably, the shoulder 56 is spaced radially from the outer peripheral flange portion 48. The drill retaining member 30 is positioned in the upper portion 52 of the internal bore 50 so that the socket 34 or central bore of the drill retaining member 30 is coaxially aligned with the bore portions 52 and 54 of the support member 40. The coaxially aligned bores 34 and 54 provide a passageway for the transport of rock dust and cuttings produced by the action of the drill bit on the rocks from the drill housing 22, as will be explained later in greater detail.

The drill retaining member 30 includes an externally splined portion 58 that meshes with an internally splined portion 60 of the bore upper portion 52 on support member 40. With this arrangement, the support member 40 is nonrotatably connected to the drill retaining member 30. The support member upper end portion 42 also includes an externally threaded portion 62 that is arranged to receive in meshing engagement internal threads of a flinger 64. The flinger 64 has an internal bore 66 that receives a cap 68. The cap is nonrotatably connected to the flinger 64 by bolts 70. The cap 68 includes a bore that forms in drill housing 22 the opening 32 through which the upper end portion of the drill retaining member 30 extends. The cap 68 supports an O-ring 72 in sealing engagement with the external surface of the drill retaining member 30. The flinger 64 also supports an O-ring 74 in sealing engagement with the extreme upper end portion of the support member 40. With this arrangement seals 72 and 74 prevent dirt from entering the spline connection of member 30 with member 40 and the threaded connection of member 40 with the flinger 64.

The support member 40 is rotatably journaled by a bearing assembly in accordance with the present invention within the drill housing 22 in a manner to maintain the internal bore 50 coaxially aligned with the socket 34 of the drill retaining member 30. The bearing assembly for the support member 40 includes a first bearing assembly 76, as for example a plurality of ball bearings, and a second bearing assembly 78, as for example a tandem arrangement of thrust bearings 80 and ball bearings 82. The bearings of the first bearing assembly 76 rotatably support the support member upper end portion 42 and are carried by a cover 84 which closes the upper portion of the drill housing internal cavity 24. The cover 84 is secured to case 86 of housing 22 by bolts 88.

The second bearing assembly 78 rotatably supports the support member lower end portion 44 in the drill housing 22. The bearings 80 and 82 of the bearing assembly 78 are carried by the case 86 and the intermediate body portion 46 of support member 40. With this arrangement a cavity 90 is formed by the support member upper end portion 42, the flinger 64, and the cover 84 for receiving lubricant for the first bearing assembly 76. Similarly, the bearings of the second bearing assembly 78 are contained in a cavity 92 formed by the case 86, the support member intermediate portion 46, and the cover 84.

The bevel pinion 26 and the ring gear 36 are positioned in cavity 92. The opening 20 through which the drive shaft 18 extends is suitably sealed to prevent the escape of lubricant from the cavity 92 through the opening 20. With this arrangement, lubricant is supplied to the cavity 92 for the meshing gears 26 and 36, as well as, the bearing assembly 78 through one-way lubricant inlet port 94 that extends through the case 86 into the cavity 92. A one-way lubricant outlet port 95 is provided for venting lubricant from cavity 92 when the fluid pressure therein exceeds a preselected magnitude.

The second bearing assembly 78 rotatably supports the support member lower end portion 44 within the drill housing 22. An annular space 96 is thus formed between the outer surface of the lower end portion 44 and the case 86. The annular space 96 is sealed by a carrier member generally designated by the numeral 98. The carrier member 98 includes an externally threaded cylindrical body portion 100 and an internal bore 102 that receives a seal assembly generally designated by the numeral 104.

The seal assembly 104 is concentrically positioned in sealing engagement with the support lower end portion 44. An O-ring 106 is positioned between the case 86 and the exterior surface of the carrier member 98 above the threaded portion 100. The seal assembly 104 and the O-ring 106 prevent the escape of lubricant from the cavity 92 through the annular space 96 between the case 86 and the support member lower end portion 44. The seals 104 and 106 prevent the entrance of foreign material into the cavity 92 through the annular space 96.

Figure 3:
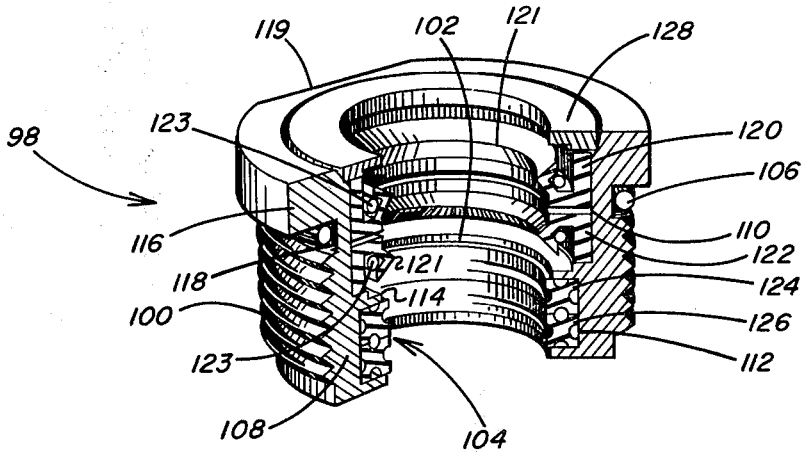
FIG. 3 is an orthographic sectional view of a cylindrical member having a seal assembly for maintaining a seal in the lower end portion of the drill head.

Referring to FIG. 3, the carrier member 98 and the seal assembly 104 is illustrated in greater detail. As illustrated in FIG. 3, the carrier member 98 has an elongated body portion 108 provided with external threads 100. The internal bore 102 has an enlarged diameter portion 110 separated from a reduced diameter 112 by an inturned shoulder 114. An upper peripheral shoulder 116 extends outwardly from the body portion 108 above the threaded portion 100 and is separated from the threaded portion 100 by a recess 118 that receives the O-ring seal 106. The peripheral shoulder 116 is provided with a flat 119 to facilitate engagement of the carrier member 98 with case 86.

The seal assembly 104 is positioned in the internal bores 110 and 112 in surrounding and sealing relation with the tubular member lower end portion 44. The function of the seal assembly 104 is to prevent the escape of lubricant from the cavity 92 around the lower end portion of the support member 40. Also the seal assembly 104 prevents the entrance of foreign material, particularly dust and rock cuttings, from the support member bore 54 through the annulus 96 into the cavity 92.

Preferably, the seal assembly 104 includes a plurality of O-ring-type seal members which are stacked in surrounding relation with the support member lower end portion 44. As for example, a pair of O-ring lip seals 120 and 122 are positioned in overlying relation in the enlarged diameter bore portion 110. Each seal 120 and 122 includes a lip 121 urged by an annular spring 123 into sealing engagement with the support member end portion 44. A pair of quad rings 124 and 126 are positioned in overlying relation in the bore reduced diameter portion 112.

As illustrated in FIG. 3, the O-ring lip seal 122 is separated from the quad ring 124 by the shoulder 114. Positioned in overlying relation with the lip seal ring 120 and seated within the upper portion of bore 110 is a rigid annular member 128, such as a washer. The support member lower end portion 44 extends through the annular member 128 and is thereby guided axially into the bore 102. This arrangement assures that the lip seal rings 120 and 122 and the quad rings 124 and 126 sealingly engage the support member lower end portion 44.

The rigid annular member 128 is positioned within the upper end of bore 110. The diameter of the bore through the annular member 128 is substantially equal to the external diameter of the portion of support member 40 that extends through the carrier member 98. Thus, the rigid annular member 128 maintains the support member 40 coaxially aligned with the bore 102 of carrier member 98.

As the support member lower end portion 44 is extended through the carrier member 98, the rigid annular member 128 guides the end portion 44 through the bore 102 along an axial path. In this manner the various rings of the seal assembly 104 are not damaged when the support member 40 is inserted in the carrier member 98. Furthermore, the rigid annular member 128 may serve to stabilize the support member lower end portion 44 and maintain the lower end portion in axial alignment with the drill retaining member 30. Thus, any lateral forces which are applied to the support member lower end portion 44 are taken up by the rigid annular member 128 to prevent the forces from being transmitted to the seals 120, 122, 124 and 126 and damaging the seals.

The seals 120, 122, 124 and 126 are subjected to the pressure of lubricating fluid in the cavity 92. Heretobefore in the event of failure of the seals of motor 12, causing a substantial increase in the fluid pressure in cavity 92, the seals surrounding the bearings 80 and 82 also failed. Consequently, the bearings experienced excessive wear. However, with the provision of the pressure relief port 95 of the present invention, an excessive buildup of fluid pressure in cavity 92 is prevented. When the fluid pressure exceeds a preselected magnitude, relief port 95 opens allowing fluid to escape from cavity 92. This reduces the fluid pressure in cavity 92 to a permissible magnitude which is not damaging to the seals 120, 122, 124, and 126. Consequently, this arrangement permits use of low pressure seals with the present invention in comparison with the high pressure seals of conventionally known drill head assemblies.

An access plug 130 is threadedly secured to the drill housing 22 to permit access into the drill housing below the support member 40 for the purpose of removing an accumulation of dust and rock cuttings conveyed from the central bore of the bit and drill steel. As well known in the art, the drill housing 22 is provided with an exhaust port 133 communicating with the portion of the cavity of the drill housing 22 below the support member lower end portion 44. The exhaust port 133 is connected by conduits to a conventional vacuum dust collecting system. With this arrangement dust and rock cuttings are drawn through the drill bit and the drill head into a collection box without escaping into the air.

The first bearing assembly 76 is also protected against the entrance of foreign material, such as rock cuttings, into cavity 90 by a seal assembly that includes a pair of O-ring lip seals 131 and 132 positioned on opposite sides of the bearings comprising the assembly 76. The lip seal 131 is positioned in the cavity 90 above the ball bearings 76 and includes a resilient annular member 134 supported by annular clip 135. A lip 136 of annular member 134 is urged into sealing engagement by an annular spring 138 against the surface of flinger 64. Thus, the lip seal 131 is operable to seal the bearing assembly 76 against the entry of foreign matter into contact with the bearing assembly 76.

The O-ring lip seal 132 is similar to lip seal 131 and is positioned below the ball bearings 76 in the cavity 90. The lip seal 132 also includes a resilient annular member 134 supported by clip 135 and having a lip 136 maintained in sealing engagement with the outer surface of the support member 40 by annular spring 138. Lubricant for the bearings 76 is applied to the cavity 90 through a passageway 140 that extends from a fitting 142 on the exterior surface of cover 84 through the cover and into the cavity 90. The seal 132 has its pressure side extending toward the bearings 76 to thereby prevent lubricant from escaping the cavity 90 and flowing into cavity 92.

The seal 131 has its pressure side extennding away from the bearings 76 so as to permit excess lubricant to escape from the cavity 90 and flow through the labyrinth or passageway 144 separating the flinger 64 and cover 84. The passageway 144 extends from the seal 131 through the drill housing 22. In the event of an excessive buildup of lubricant in the cavity 90 to the magnitude where the pressure of the lubricant supplied to the bearings 76 exceeds a preselected pressure, the excess lubricant is conveyed out of the drill housing through the passageway 144. In this manner the excess lubricant is permitted to escape from the cavity 90 through the labyrinth or passageway 144. An excessive buildup of fluid pressure in the drill housing 22 is prevented and the fluid pressure is maintained at a level to thereby prevent damage to the lip seals 131 and 132.

As further illustrated in FIG. 2, the drill retaining member 30 extends through the upper bore 52 of the support member 40 and is supported at its lower end portion by the support member internal shoulder 56. In order to further stabilize the drill retaining member 30 within the support member 40 and prevent wear of the support member internal bore 50, an annular member 146 is positioned on the shoulder 56. The end of the drill retaining member 30 is positioned in abutting relation with the annular member 146. An O-ring seal 148 is positioned above member 146 in an annular recess of drill retaining member 30 and sealingly engages the support member 40. By extending the drill retaining member 30 into the support member 40 and positioning the end of the member 30 opposite the enlarged intermediate body portion 46 and on the shoulder 56, the member 30 is securely stabilized within the drill housing 22.

The lateral thrust forces applied to the drill retaining member 30 by the drill steel are transmitted to the intermediate body portion 46 of the support member 40, as opposed to being applied directly to the bearing assemblies 76 and 78. By transmitting the lateral thrust forces to the enlarged portion 46 of the support member 40, the member 30 is prevented from deflecting laterally. This, in turn, stabilizes the support member upper end portion 42 so that the end portion 42 maintains its axial position relative to the bearing assembly 76.

By substantially removing application of the thrust forces upon the bearing assembly 76 and the bearing assembly 78 and transmitting the thrust forces to the portion of the support member 40 most capable of resisting these forces (i.e. intermediate body portion 46), the wear upon the bearing assemblies is substantially minimized. The bearings are maintained in alignment and consequently the operating efficiency of the rotary motor 12 is improved. Furthermore, by reducing the wear upon the bearings, the life of the seals is extended to reduce the frequency of replacement of the seals. This, in turn, reduces the downtime of the drill head attributed to replacement of bearings and seals.

Figure 4:
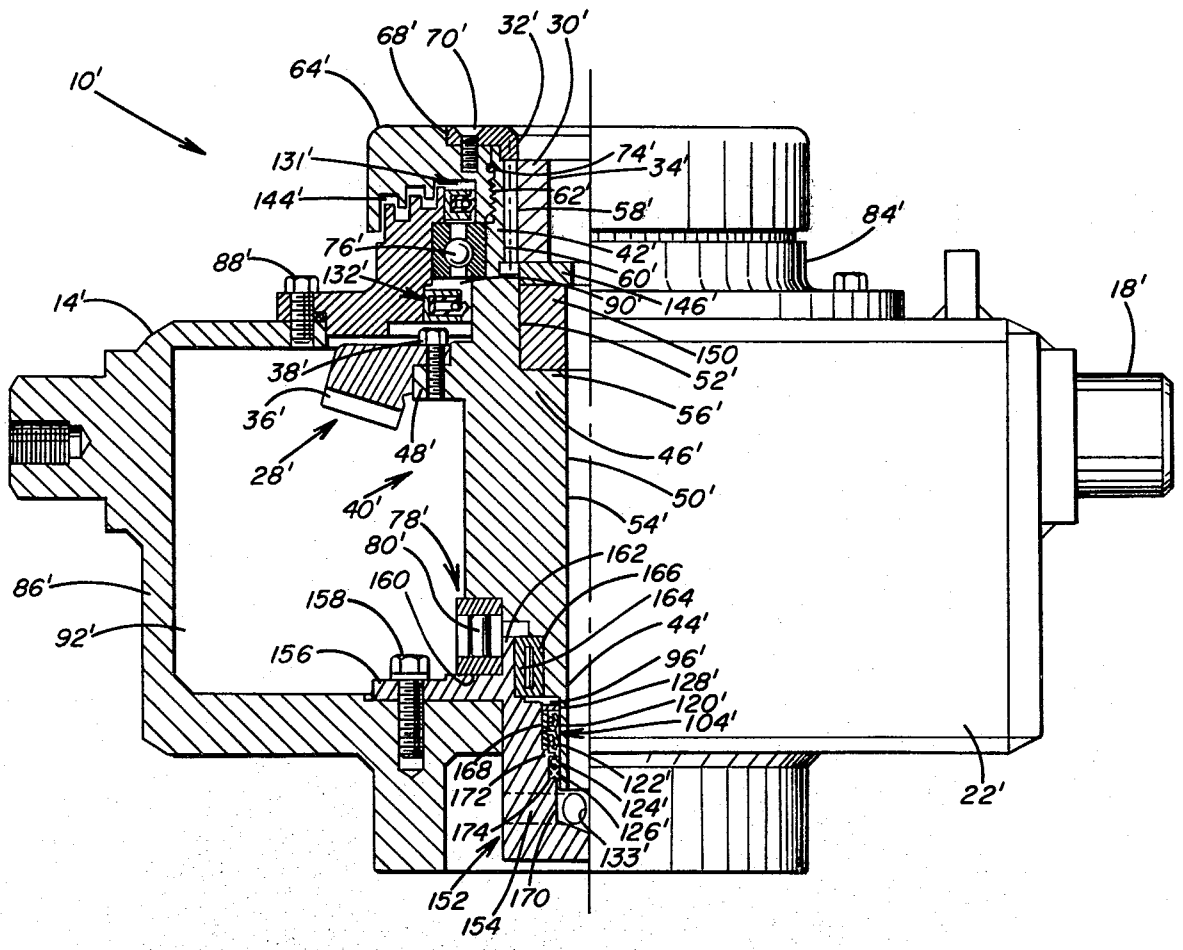
FIG. 4 is a view similar to FIG. 2, illustrating another embodiment of the drill head assembly of the present invention in which the drill retaining member has a reduced length and a carrier is provided for both the bearings and the seal in the lower end portion of the drill head.

Referring to FIG. 4, there is illustrated another embodiment of the rotary drill assembly 10 of the present invention in which the parts of FIG. 4 which are similar to corresponding parts of FIG. 2 are designated by primed, like numerals. The drill assembly 10' in FIG. 4 is provided with a drill retaining member 30' having a reduced length in comparison with the drill retaining member 30 illustrated in FIG. 2. With the arrangement in FIG. 4, the drill retaining member 30' as above described is splined to the tubular support member 40'. The washer 146' supports the lower end of the drill retaining member or chuck 30' in the upper portion 52' of the internal bore 50' of the support member 40'. The washer 146' is spaced from the internal shoulder 56' of the support member intermediate body portion 46' and is supported by a cylindrical spacer 150. As with the arrangement described above for FIG. 2, the drill retaining member 30' of FIG. 4 is supported in the drill housing 22' by the intermediate body portion 46' to resist lateral thrust applied to the drill retaining member 30' by the drill steel. By supporting the drill retaining member 30' in this manner, lateral shifting movement of the drill retaining member 30' in the drill housing 22' is prevented.

The seal assembly 104 that sealingly engages the tubular support member lower end portion 44' within the annular space 96' is supported by a combination bearing and seal carrier member generally designated by the numeral 152. The carrier 152 has a cylindrical body portion 154 and an upper outwardly extending flange portion 156. The cylindrical body portion 154 extends through the opening in the lower end of the gear case 86', and the outwardly extending flange portion 156 is positioned in abutting relation with the body portion of the gear case 86'. The flange portion 156 is nonrotatably secured to the gear case 86' by bolts 158.

The carrier member 152 not only supports the seal assembly 104' in surrounding relation with the support member lower end portion 44' but also supports the second bearing assembly 78' to, in turn, rotatably support the tubular support member lower end portion 44'. To this end the carrier flange portion 156 has a surface 160 upon which thrust bearings 80' of the bearing assembly 78' are positioned. Extending upwardly from the flange surface 156 is an annular portion 162 forming an upper bore portion 164 of a bore extending through the carrier 152. Needle bearings 166 of the bearing assembly 78' are positioned in the upper bore portion 164. Thus, with this arrangement the thrust bearings 80' and the needle bearings 166 are maintained in a fixed position by the carrier member 152 to rotatably support the tubular support member lower end portion 44' in the drill housing 22'.

Positioned below the upper bore portion 164 of the carrier member 152 is an intermediate bore portion 168 for receiving in stacked relation the rigid annular member or washer 128' and the lip seal rings 120' and 122'. The intermediate bore portion 168 is separated from a lower bore portion 170 by an inturned shoulder 172 that supports the lower lip seal ring 122'. Positioned in the lower bore portion 170 are the quad rings 124' and 126'. The quad ring 126' is positioned on a lower shoulder 174. With this arrangement the seal assembly 104', i.e. the seal rings 120' and 122' and the quad rings 124' and 126', are maintained in sealing engagement with the tubular member lower end portion 44' so as to prevent the entrance of foreign matter into the drill housing cavity 92' and the escape of lubricant out of the cavity 92'.

Thus, it will be apparent by positioning the seal assembly 104' in the lower portion of the gear case rather than in a position in the upper portion of the gear case closely adjacent to where the drill retaining member 30' is connected to the tubular support member 40', the deflection forces applied to the seal assembly 104' are substantially reduced or minimized. Also supporting the thrust bearings 80' and the needle bearings 166 by the carrier member 152 maintains the tubular support member lower end portion 44' coaxially alinged in the drill housing to further reduce deflection of the lower end portion 44' and accordingly wear upon the seal assembly 104'. With the seal assembly 104' in this position, the life of the seal assembly is extended. Consequently, the downtime for removing the rotary drill assembly, 10 from operation to repair the drill assembly 10' and specifically to replace worn seals and bearings is substantially reduced.

According to the provisions of the Patent Statutes, I have explained the principal, preferred construction and mode of operation of my invention and have now described what I now consider to represent its best embodiments. However, it should be understood that, within the scope of the appended claims, the invention may be practiced otherwise than as specifically illustrated and described.

I claim:

1. A drill head assembly comprising, a drill housing having an internal cavity with an upper opening and a lower opening extending therethrough, a rotatable drill retaining member positioned in said drill housing internal cavity and extending through said upper opening, said drill retaining member having a central bore therethrough, a tubular member coaxially aligned with said drill retaining member, said tubular member having an internal bore for receiving said drill retaining member, said tubular member internal bore extending axially through said drill housing internal cavity from said upper opening to said lower opening and adaptable for the conveyance of rock cuttings and dust therethrough, means for nonrotatably connecting said drill retaining member to said tubular member in said internal bore thereof, drive means positioned in said drill housing for rotating said tubular member, said tubular member having an upper end portion and a lower end portion with an intermediate body portion positioned between said upper and lower end portions in said internal cavity, said tubular member upper and lower end portions being positioned oppositely of said internal cavity upper and lower openings respectively, said drill retaining member being supported in said drill housing by said tubular member intermediate body portion to resist lateral thrust and thereby prevent lateral shifting movement of said drill retaining member in said drill housing, said drill retaining member central bore and said tubular member internal bore being aligned to form a continuous passageway for the conveyance of rock cuttings and dust produced during the drilling operation from said internal cavity upper opening to said internal cavity lower opening and out of said drill housing, said continuous passageway being subjected to a reduced pressure to evacuate said rock cuttings and dust out of said drill housing to a suitable collection point, said tubular member lower end portion being positioned in said drill housing to form an annular space between said tubular member lower end portion and said drill housing adjacent said internal cavity lower opening, a carrier member positioned in said annular space and nonrotatably connected to said drill housing, said carrier member including a body portion having an internal bore concentric with said annular space, said carrier member internal bore including an enlarged diameter portion positioned above a reduced diameter portion with an inturned shoulder separating said enlarged diameter portion from said reduced diameter portion, seal means positioned in said carrier member bore enlarged and reduced diameter portions between said tubular member lower end portion and said carrier member for sealing said annular space around said tubular member lower end portion in said drill housing, said seal means including a plurality of annular seals positioned in overlying relation in said bore enlarged diameter portion, each of said annular seals including a sealing lip urged into sealing engagement with said tubular member lower end portion, a pair of sealing rings positioned in overlying relation in said bore reduced diameter portion and sealingly engaging said tubular member lower end portion below said annular seals, an upper shoulder extending outwardly from said carrier member body portion, means positioned between said carrier member body portion and said drill housing below said shoulder for sealing around said carrier member to prevent the escape of lubricant from said drill housing internal cavity through said annular space, dust evacuation means positioned below said carrier member and communicating with said continuous passageway through said drill retaining member and said tubular member for maintaining said annular seals removed from contact with the rock cuttings and dust by the evacuation thereof from said drill housing, and said seal means being operable to prevent the escape of lubricant from said cavtiy through said annular space around said tubular member lower end portion and the entrance of foreign matter through said annular space into said cavity.

2. A drill head assembly as set forth in claim 1 which includes, said carrier member including means for maintaining said tubular member lower end portion axially positioned in said drill housing to ensure sealing engagement of said seal means with said tubular member lower end portion.

3. A drill head assembly as set forth in claim 1 which includes, said carrier member body portion having an externally threaded portion positioned below said shoulder for threadedly engaging said drill housing to close said annular space between said tubular member lower end portion and said drill housing, and said means for sealing around said carrier member being positioned between said shoulder and said externally threaded portion.

4. A drill head as set forth in claim 1 which includes, a rigid annular member positioned in said carrier member enlarged diameter portion above said annular seals, and said rigid annular member having a bore therethrough for receiving said tubular member lower end portion so that said rigid annular member is operable to guide said tubular member lower end portion into sealing relation with said annular seals and sealing rings without damaging said annular seals and sealing rings.

5. A drill head assembly comprising, a drill housing having an internal cavity with an opening extending therethrough, a rotatable drill retaining member positioned in said drill housing internal cavity and extending through said opening, said drill retaining member having a central bore therethrough, a tubular member coaxially aligned with said drill retaining member, said tubular member having an internal bore for receiving said drill retaining member, means for nonrotatably connecting said drill retaining member to said tubular member in said internal bore thereof, drive means positioned in said drill housing for rotating said tubular member, said tubular member having an upper end portion and a lower end portion with an intermediate body portion positioned between said upper and lower end portions, said drill retaining member being supported in said drill housing by said tubular member intermediate body portion to resist lateral thrust and thereby prevent lateral shifting movement of said drill retaining member in said drill housing, said tubular member lower end portion being positioned in said drill housing to form an annular space between said tubular member lower end portion and said drill housing, a carrier member positioned in said annular space and nonrotatably connected to said drill housing, said carrier member including a body portion having an internal bore concentric with said annular space, said carrier member internal bore including an enlarged diameter portion positioned above a reduced diameter portion with an inturned shoulder separating said enlarged diameter portion from said reduced diameter portion, seal means positioned in said carrier member bore between said tubular member lower end portion and said carrier member for sealing said annular space around said tubular member lower end portion in said drill housing, said seal means including a plurality of annular seals positioned in overlying relation in said bore enlarged diameter portion, each of said annular seals including a sealing lip urged into sealing engagement with said tubular member lower end portion, a pair of sealing rings positioned in overlying relation in said bore reduced diameter portion and sealingly engaging said tubular member lower end portion below said annular seals, an upper shoulder extending outwardly from said carrier member body portion, means positioned between said carrier member body portion and said drill housing below said shoulder for sealing around said carrier member to prevent the escape of lubricant from said drill housing internal cavity through said annular space, bearing means positioned above said drive means in said drill housing cavity for rotatably supporting said tubular member upper end portion, first seal means positioned between said bearing means and said drive means for maintaining lubricant supplied to said bearing means in contact with said bearing means, said first seal means including a pressure side extending toward said bearing means to retain lubricant in surrounding relation with said bearing means and prevent lubricant from escaping out of said bearing means and into said drive means, second seal means positioned above said bearing means for sealing said bearing means against the entry of foreign matter into contact with said bearing means, said second seal means including a pressure side extending away from said bearing means to permit excess lubricant to be conveyed out of said bearing means, means for supplying lubricant through said drill housing to said bearing means, and a passageway extending from said second seal means through said drill housing for conveying excess lubricant out of said drill housing when the pressure of the lubricant supplied to said bearing means exceeds a preselected pressure to prevent an excessive buildup of fluid pressure in said drill housing and maintain the fluid pressure at a level preventing damage to said carrier member seal means.

* * * * *